US011529278B2

(12) United States Patent
Diaz et al.

(10) Patent No.: US 11,529,278 B2
(45) Date of Patent: Dec. 20, 2022

(54) METHODS AND APPARATUS FOR ARTIFICIAL KANGAROO CARE

(71) Applicant: COSMOS LLC, Hanover, MD (US)

(72) Inventors: Abraham Diaz, Hanover, MD (US); Johana Diaz, Hanover, MD (US)

(73) Assignee: COSMOS LLC, Hanover, MD (US)

( * ) Notice: Subject to any disclaimer, the term of this patent is extended or adjusted under 35 U.S.C. 154(b) by 950 days.

(21) Appl. No.: 16/355,493

(22) Filed: Mar. 15, 2019

(65) Prior Publication Data

US 2019/0282420 A1 Sep. 19, 2019

Related U.S. Application Data

(60) Provisional application No. 62/644,286, filed on Mar. 16, 2018.

(51) Int. Cl.

| | |
|---|---|
| ***A61G 11/00*** | (2006.01) |
| ***A41B 13/06*** | (2006.01) |
| ***A47D 15/00*** | (2006.01) |
| ***A47G 9/08*** | (2006.01) |
| *A47D 9/00* | (2006.01) |

(52) U.S. Cl.

CPC ..... *A61G 11/00* (2013.01); *A41B 13/06* (2013.01); *A47D 15/001* (2013.01); *A47D 9/00* (2013.01); *A47G 9/083* (2013.01); *A61G 2203/46* (2013.01)

(58) Field of Classification Search

CPC .... A61G 11/00; A61G 2203/46; A41B 13/06; A41B 13/065; A47D 15/001; A47D 9/00; A47G 9/083; A47G 9/08

USPC ..... 5/655, 652; 600/22, 21

See application file for complete search history.

(56) References Cited

U.S. PATENT DOCUMENTS 6,918,770 B2 * 7/2005 Odiwo ..... A47D 15/006 434/266

7,107,639 B2 * 9/2006 Taricani ..... A47D 13/08 5/915

(Continued)

FOREIGN PATENT DOCUMENTS

WO WO-2022098951 A1 * 5/2022 ..... A61G 11/00

OTHER PUBLICATIONS

Diaz, Abraham R., Mother Skin-to-Skin Care, Kangaroo, Final Paper BU.120.601.52, Johns Hopkins University, Oct. 11, 2017.

(Continued)

*Primary Examiner* — Robert G Santos

(74) *Attorney, Agent, or Firm* — Hutchison Law, LLC; Linda S. Hutchison, Esq.

(57) ABSTRACT

Methods and apparatus for artificial kangaroo care supporting and promoting health needs in premature babies, babies in neonatal intensive care, and other newborn infants are disclosed. The artificial kangaroo care apparatus may imitate a pre-birth maternal environment and may include an odor-absorbent material imitating a mother's smell, a means for imitating a mother's heartbeat, a means for imitating a mother's breathing pattern, a means for imitating a mother's body temperature, or any combination thereof. The shape and structure of the artificial kangaroo care apparatus may support stand-alone use or use within an incubator or other structure. The shape and structure of the artificial kangaroo care apparatus may suggest a mattress, a mattress covering, or a pillow.

18 Claims, 5 Drawing Sheets

(56) References Cited

U.S. PATENT DOCUMENTS

| | | | | |
|---|---|---|---|---|
| 7,464,424 | B1 * | 12/2008 | Formica | A47D 13/025 5/915 |
| 7,475,441 | B1 * | 1/2009 | Soberal | A47D 9/02 5/904 |
| 8,082,615 | B1 * | 12/2011 | Alkhattaf | A47C 27/082 5/655 |
| 8,898,841 | B2 * | 12/2014 | Esch | A47D 13/02 5/655 |
| 2004/0077287 | A1 * | 4/2004 | Odiwo | A61M 21/00 446/491 |
| 2005/0278854 | A1 * | 12/2005 | Taricani, Jr. | A47D 13/08 5/655 |
| 2013/0025062 | A1 * | 1/2013 | Esch | A47D 13/08 5/655 |
| 2014/0082839 | A1 * | 3/2014 | Piombino | A47D 15/00 5/421 |
| 2014/0275742 | A1 * | 9/2014 | Andrew | A41B 13/06 600/27 |
| 2015/0126803 | A1 * | 5/2015 | Rapoport | A61B 5/165 600/22 |
| 2019/0282420 | A1 * | 9/2019 | Diaz | A61G 11/00 |
| 2022/0225791 | A1 * | 7/2022 | DelSignore | A47D 13/06 |

OTHER PUBLICATIONS

Moore ER, Bergman N, Anderson GC, Medley N, Eady skin-to-skin contact for mothers and their healthy newborn infants (Review), Cochrane Database of Systematic Reviews 2016, Issue 11 Art. No. CD003519, pp. 1-7, John Wiley & Sons, Ltd.

Johns Hopkins Medicine, Manikin-Based Simulations. Retrieved from the simulation center: http://www.hopkinsmedicine.org/simulation_center/training/manikin_based_simulations/index.html.

Laila Kristofferson et al, Eady skin-to-skin contact or incubator for very preterm infants: study protocol ~ for a randomized controlled trial, Trials (2016) 17:593.

Al Jefferies; Canadian Paediatric Society, Fetus and Newborn Committee. Kangaroo care for the preterm infant and family. Paediatr Child Health 2012;17(3):141-143.

* cited by examiner

METHODS AND APPARATUS FOR ARTIFICIAL KANGAROO CARE

CROSS-REFERENCE TO RELATED APPLICATION

This application claims the benefit of U.S. Provisional Application No. 62/644,286, filed on Mar. 16, 2018.

BACKGROUND OF THE INVENTION

A change in environmental temperature at birth between a mother's body and a birthing room may shock a newborn infant. To minimize impacts from the shock, standard hospital care may comprise Kangaroo Mother Care. Kangaroo Mother Care, also known as Kangaroo Care, may comprise, at a minimum, direct skin-to-skin contact between the newborn and mother. In common practice, Kangaroo Care may comprise holding a newborn skin-to-skin at a mother's breasts, or holding a newborn skin-to-skin on a father's chest. In some cases, skin-to-skin contact may begin immediately at birth and last continually through a first breastfeeding. Accordingly, standard hospital care may comprise immediate, skin-to-skin contact between a newborn and a mother or father.

Situations involving premature babies and babies in neonatal intensive care pose particular challenges to Kangaroo Care methods. For many premature births, an infant is not given to the mother for skin-to-skin contact until the child and mother are medically stable. Indeed, standard care may require separation between a premature baby and a mother for more than 24 hours to 1 or 2 weeks. Further, tubes, monitors, and other equipment supporting the premature baby during the first hours after birth may interfere with skin-to-skin contact. Accordingly, premature babies or babies in neonatal intensive care may not fully realize Kangaroo Care benefits.

SUMMARY OF THE PRESENT INVENTION

Various exemplary embodiments of the present disclosure may demonstrate one or more of the invention features. Other features and advantages of this invention will become apparent from the following detailed description of the presently preferred embodiment of the invention, taken in conjunction with the accompanying drawings.

In accordance with an exemplary embodiment, an artificial kangaroo care apparatus may include a means for imitating primary data and a means for imitating smell.

In accordance with another exemplary embodiment, a method of assembling an artificial kangaroo care apparatus may include capturing primary data. The method may further include calibrating at least one regulating means in view of the capture data. The method may further include assembling the apparatus and regulating the at least one calibrated means.

In accordance with a further exemplary embodiment, a method of preparing an odor-absorbent material may include positioning material in communication with primary skin. The method may further include absorbing odor from the primary skin into the positioned material. The method may further include positioning the odor-absorbed material in communication with infant skin.

It is to be understood that both the foregoing general description and the following detailed description are exemplary and explanatory only and are not restrictive of the present disclosure or claims.

BRIEF DESCRIPTION OF THE DRAWINGS

The drawings referenced herein are incorporated in and form part of the specification. The drawings illustrate one or more exemplary embodiments of the present disclosure and together with the description serve to explain various principles and operations. Implications that the drawings illustrate all embodiments of the invention are not to be made.

DETAILED DESCRIPTION OF THE INVENTION

Figure 1A:
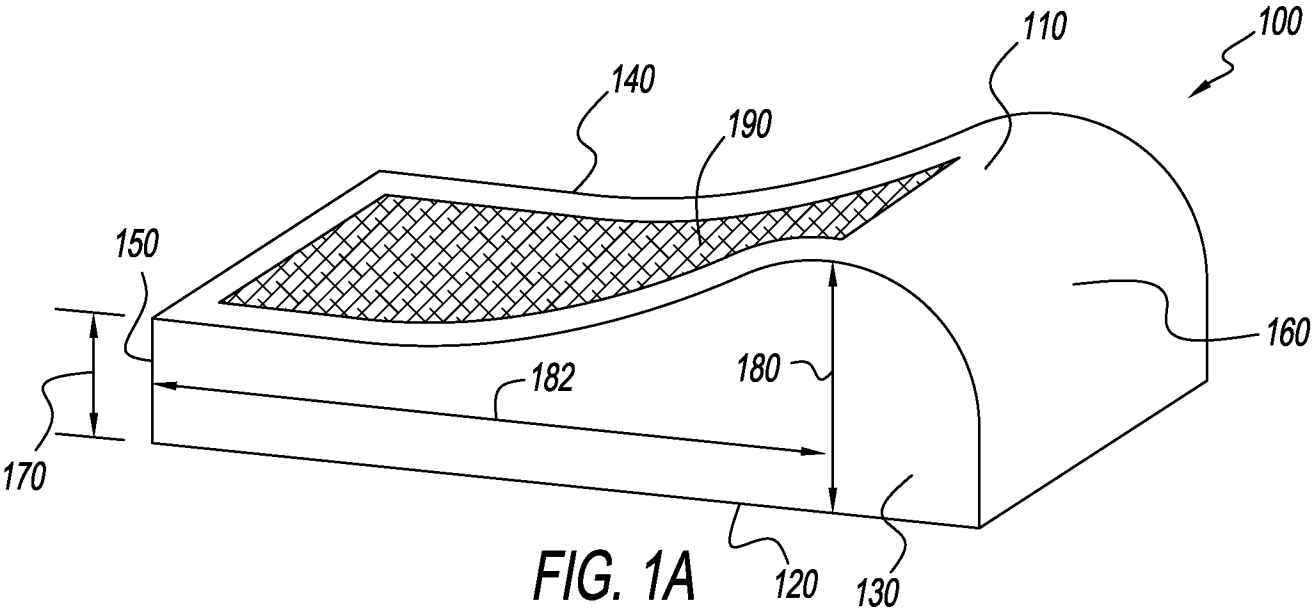
FIGS. 1A-1B illustrate perspective views of exemplary embodiments of an artificial kangaroo care apparatus.

Reference will now be made in detail to various exemplary embodiments of the present disclosure, examples of which are illustrated in the accompanying drawings.

It will be readily understood that the components of the present invention, as generally described and illustrated in the figures herein, may be arranged and designed in a wide variety of different configurations. Thus, the following detailed description of the embodiments of the artificial kangaroo care apparatus and methods of the present invention, as presented in the figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearance of the phrases "a select embodiment," "in one embodiment," or "in an embodiment" in various places throughout this specification are not necessarily referring to the same embodiment.

Features, structure, or characteristics described herein may be combined in any suitable manner in one or more embodiments. One skilled in the relevant art will recognize, however, that the invention may be practiced without one or more of the specific details, or with other methods, components, or materials. In other instances, well-known materials or processes are not shown or described in detail to avoid obscuring aspects of the invention. The following description, which shows by way of illustration the specific embodiment in which the invention may be practiced, is intended only by way of example. That is, the following description simply illustrates certain selected embodiments of artificial kangaroo care apparatus and methods that are consistent with the invention as claimed herein. It is to be understood that other embodiments may be utilized because structural and process changes may be made without departing from the scope of the present invention.

A change in environmental temperature at birth between a mother's body and a birthing room may shock a newborn infant. To minimize chances of hypothermia, standard hospital care may comprise placing newborns in incubators or under radiant warmers. Alternatively, or in addition, hospitals may encourage Kangaroo Mother Care (KMC). KMC, or Kangaroo Care, may comprise, at a minimum, direct skin-to-skin contact (SSC) between the newborn and mother. In common practice, Kangaroo Care may comprise holding a newborn skin-to-skin at a mother's breasts, or holding a newborn skin-to-skin on a father's chest. Generally, a newborn may be placed Chest-to-Chest on the mother or father's chest. In these situations, to preserve body heat and promote Kangaroo Care benefits, hospital procedures may support placing a blanket across the baby's back, creating, in essence, a warm cocoon around the newborn and parent. Accordingly, standard hospital care may comprise skin-to-skin contact between a newborn and a mother or father.

Standard hospital care may regulate skin-to-skin timing. For example, Kangaroo Care may comprise prolonged skin-to-skin contact between the newborn and mother. In some cases, skin-to-skin contact may begin immediately at birth and last continually until the end of a first breastfeeding, or longer. The timing of the skin-to-skin contact, immediately post birth, may support programming physiology and behavior. Some medical research may suggest one to three hours, daily, of skin-to-skin contact. Accordingly, Kangaroo Care timing and duration may impact realized Kangaroo Care benefits.

Kangaroo Care may promote more than body warmth and a lower risk of hypothermia in newborns. Indeed, the cocoon environment created within the Kangaroo Care embrace may re-engage the newborn with the mother's heartbeat, smell, and breathing pattern, which is reminiscent of the newborn's pre-birth existence. This after-the-birth communication between the newborn and the mother's body may activate neurological substances that help babies stay stable and calm. Indeed, by spending less time trying to keep warm, and leveraging a sense of calm, a baby's body may focus on other important development factors, such as heart and breathing rates, weight gain, sleeping patterns, and responses to pain. Even more, Kangaroo Care may reduce risk of sepsis, hypoglycemia, or hospital readmission, and improve breastfeeding. Taken together, Kangaroo Care may support longer-term outcomes by improving newborn physiological functions. Accordingly, Kangaroo Care may promote a wide range of health benefits for newborns.

Premature babies and babies in neonatal intensive care (NICU) situations may particularly benefit from any and all recognized Kangaroo Care health benefits. These babies and other low birth weight (LBW) babies are at an elevated risk of neonatal mortality and morbidity, inhibited growth and development, and chronic disease. The aforementioned Kangaroo Care benefits may suggest Kangaroo Care as an appropriate response to premature, NICU, or other LBW scenarios. Indeed, when compared to conventional care, Kangaroo Care may increase survival rates, particularly among LBW infants. Accordingly, Kangaroo Care benefits may particularly support low birth weight and many more vulnerable birth survival scenarios.

However, for many premature births, an infant is not given to the mother or father for skin-to-skin contact, or Kangaroo Care, until the child and mother are medically stable. Health concerns associated with vulnerable births may require extra medical attention and assistance immediately after delivery. In these cases, standard care may require separation between a premature baby and a mother for at least a day, if not more. Further, tubes and wires associated with premature or other vulnerable births may interfere with skin-to-skin contact positioning. Accordingly, premature or neonatal intensive care situations may impact a newborn's access to Kangaroo Care benefits.

As described herein above, infants born in vulnerable situations may not have access to traditionally defined Kangaroo Care, that is, these infants may not have an opportunity for skin-to-skin contact with a parent or other adult. With this in mind, methods and apparatus for artificial kangaroo care, as described herein below, may provide a complementary, a supplementary, or an alternative approach to achieve Kangaroo Care objectives. In an exemplary embodiment, an artificial kangaroo care apparatus, for example, may comprise elements to imitate an in utero environment. These characteristics may comprise, but are not limited to, a mother's body temperature, heartbeat, or heart rate, breathing pattern, or respiration rate, smell, or any combination thereof. These characteristics are provided for exemplary purposes, and are not meant to be limiting. Other characteristics of the in utero environment and other aspects of traditional Kangaroo Care are contemplated by the present disclosure. Accordingly, methods and apparatus of artificial kangaroo care may provide an approach to satisfy Kangaroo Care objectives.

Figure 1B:
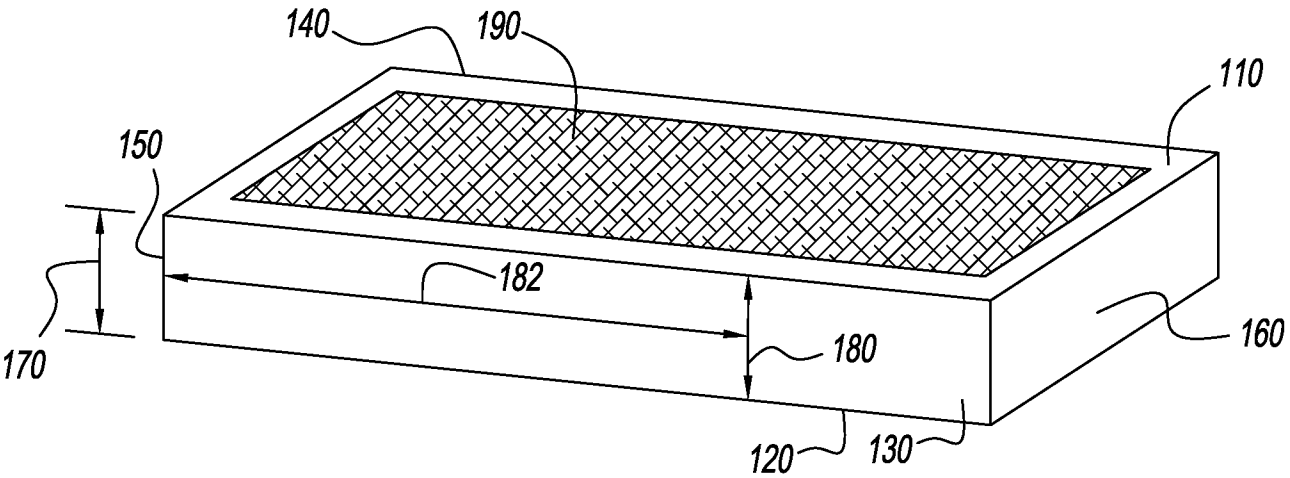

FIGS. 1A-1B illustrate perspective views of exemplary embodiments of an artificial kangaroo care apparatus (100) in accordance with the present disclosure. In an exemplary embodiment, as shown in FIGS. 1A and 1B, an artificial kangaroo care apparatus (100) may comprise a top side (110), a bottom side (120), a front side (130), a back side (140) (not visible), a left side (150), and a right side (160). In an embodiment, as shown in FIGS. 1A and 1B, a structure of the artificial kangaroo care apparatus (100) may appear self-supporting, such as a mattress or other substantially stand-alone structure. In an alternative exemplary embodiment, the structure of the artificial kangaroo care apparatus (100) may appear less self-supporting, such as a mattress sheet or other more flexible structure. The structure of the artificial kangaroo care apparatus (100) contemplated by the present disclosure may range from soft to rigid, or not self-supporting to self-supporting. In an exemplary embodiment, the structure of the artificial kangaroo care apparatus (100) may form a mattress or a mattress top. Accordingly, an artificial kangaroo apparatus may comprise a structure.

An artificial kangaroo care apparatus (100) may comprise a structure, as described above, and the structure may form a shape. In an exemplary embodiment, the front side (130) may be opposite to and substantially parallel to the back side (140) (not visible). In an alternative exemplary embodiment, a structure of the artificial kangaroo care apparatus (100) may not support parallel front side (130) and back side (140). In an exemplary embodiment, the left side side (150) may be opposite to and substantially parallel to the right side (160). In an alternative exemplary embodiment, a structure of the artificial kangaroo care apparatus (100) may not support parallel left side (150) and right side (160). Accordingly, an alternative kangaroo care apparatus may form a shape.

In an exemplary embodiment, an artificial kangaroo care apparatus (100) may comprise a first height (170) and a second height (180). In an embodiment, for example, the first height (170) may represent a height of the left side (150), and the second height (180) may represent a height at some distance (182) from the left side (150). As shown in FIG. 1A, in an exemplary embodiment, a second height (180) may exceed a first height (170). In an exemplary embodiment, the artificial kangaroo care apparatus (100) may comprise multiple and different heights, such as a third height (not shown), a fourth height (not shown), or any number of heights, which together may describe an ascent or descent in height relative to the first height (170). Accordingly, an artificial kangaroo care apparatus may imitate a slope of a human body's upper chest area.

As shown in FIG. 1B, in another exemplary embodiment, a first height (170) may be substantially similar to a second height (180). In an embodiment, for example, a top side (110) may be opposite to and substantially parallel to a bottom side (120). In an exemplary embodiment, a structure of an artificial kangaroo care apparatus (100) may form a substantially rectangular shape. Accordingly, an artificial kangaroo care apparatus may form a substantially orthogonal shape.

As described herein above, structure and shape of an artificial kangaroo care apparatus (100) may support Kangaroo Care objectives. In an exemplary embodiment, additional external aspects of the artificial kangaroo care apparatus (100) may be useful. In an exemplary embodiment, as discussed below with respect to FIGS. 2-4, the artificial kangaroo apparatus (100) may further comprise an odor-absorbed material (190). In an embodiment, for example, the odor-absorbed material (190) may be in communication with the top side (110) of the artificial kangaroo care apparatus (100). In an exemplary embodiment, the odor-absorbed material (190) may comprise a layer in communication with a portion of the top side (110) of the artificial kangaroo care apparatus (100). In another exemplary embodiment, the odor-absorbed material (190) may comprise a layer in communication with substantially all of the top side (110). In an embodiment, for example, the odor-absorbed material (190) may form a mattress sheet, or similar structure, for placement over the top side (110) from the left side (150) to the right side (160) of the artificial kangaroo care apparatus (100). In an exemplary embodiment, the odor-absorbent material (190) may be embedded in the artificial kangaroo care apparatus (100). In an exemplary embodiment, the odor-absorbent material may be substantially planar with the top side (110) of the artificial kangaroo care apparatus (100). In an embodiment, for example, the odor-absorbent material (190) may form a pocket in communication with the top side (110) of the artificial kangaroo care apparatus (100). For example, in an embodiment, an infant may be positioned within a pocket formed by the odor-absorbent material (190), which may be in communication with the top side (110) of the artificial kangaroo care apparatus (100). Accordingly, an artificial kangaroo care apparatus may comprise an odor-absorbent material to support Kangaroo Care objectives.

Figure 2:
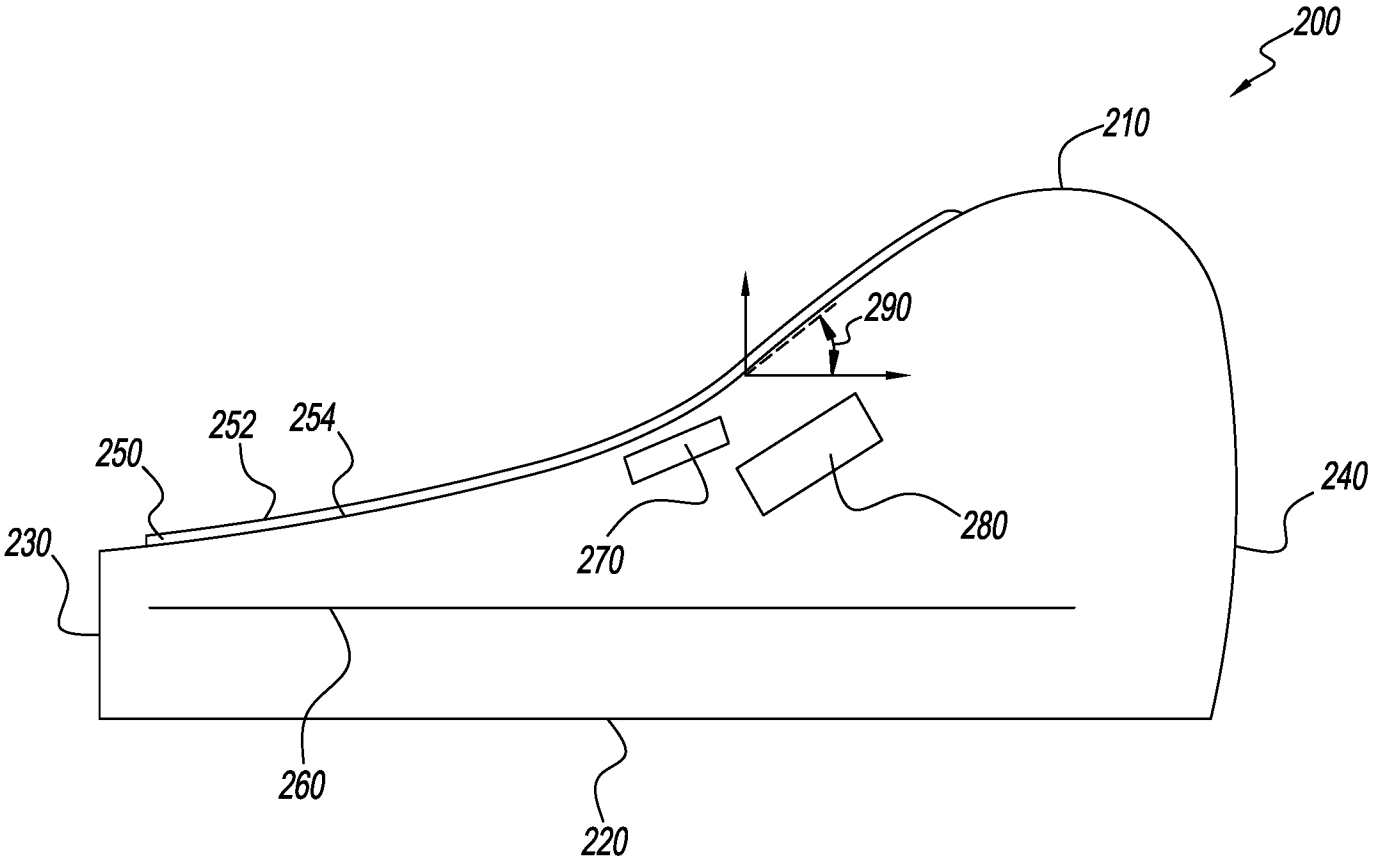
FIG. 2 illustrates a cross-sectional view of an artificial kangaroo care apparatus.

FIG. 2 illustrates a cross-sectional view of an artificial kangaroo care apparatus (200) in accordance with the present disclosure. The artificial kangaroo care apparatus (200) may comprise a top side (210), a bottom side (220), a left side (230), and a right side (240). As described with respect to FIGS. 1A and 1B, the shape and structure of the artificial kangaroo care apparatus (200) may range from soft to rigid, or undefined to defined. For example, in an embodiment, the shape and structure of the artificial kangaroo care apparatus (200) may form a supplement to an incubator mattress or pad. Alternatively, in an exemplary embodiment, the shape and structure of the artificial kangaroo care apparatus (200) may form a stand-alone mattress for placement within or outside of an incubator. As further described with respect to FIGS. 1A and 1B, the artificial kangaroo care apparatus (200) may comprise curved or flat aspects. In an exemplary embodiment, the artificial kangaroo care apparatus (200) may comprise an angle (290). As described herein above with respect to FIG. 1A, the top side (210) may rise at an angle (290) relative to the bottom side (220). The angle (290) of an artificial kangaroo care apparatus (200) may imitate human body curvature. Accordingly, the shape and structure of an artificial kangaroo care apparatus may support Kangaroo Care objectives.

An artificial kangaroo care apparatus (200) may further comprise an odor-absorbent material (250) with a top side (252) and a bottom side (254). In an exemplary embodiment, the bottom side (252) of the odor-absorbent material (250) may be in communication with a top side (210) of the artificial kangaroo care apparatus (200). The odor-absorbent material (250) may cover a portion of the top side (210). Alternatively, for example, in an embodiment, the odor-absorbent material (250) may cover substantially all of the top side (210). In a further exemplary embodiment, the odor-absorbent material (250) may cover substantially all of the artificial kangaroo care apparatus (200). In an exemplary embodiment, the odor-absorbent material (250) may lay substantially flat on the top side (210) of the artificial kangaroo care apparatus (200). As described with respect to FIGS. 1A and 1B, in another exemplary embodiment, the odor-absorbent material (250) may be embedded within the top side (210) of the artificial kangaroo care apparatus (200). In another embodiment, for example, the odor-absorbent material (250) may form a pocket or pouch, for example, for infant placement. Accordingly, an artificial kangaroo care apparatus may comprise an odor-absorbent material.

An artificial kangaroo care apparatus (200) in accordance with the present disclosure may imitate an infant's pre-birth environment. With reference to FIGS. 1A and 1B, in an embodiment, for example, a means for imitating a mother's heartbeat (not shown) may be enclosed within the artificial kangaroo care apparatus (100) to create vibrating waves at the top side (110). In an exemplary embodiment, a means for imitating a mother's breathing pattern (not shown) may be enclosed within the artificial kangaroo care apparatus (100) to imitate an up and down chest movement at the top side (110). In another exemplary embodiment, a means for imitating a mother's body temperature (not shown) may be enclosed within the artificial kangaroo care apparatus (100) to warm the top side (110). In some instances, the temperature means may be positioned approximately about 13 millimeters from the top side (110). Accordingly, an artificial kangaroo care apparatus may comprise means to imitate an infant's pre-birth environment.

With reference to FIG. 2, in an exemplary embodiment, the artificial kangaroo care apparatus (200) may comprise a temperature regulating means (260), a heartbeat regulating means (270), a breathing pattern regulating means (280), or any combination thereof. This selection and identification of means is provided for exemplary purposes and is not meant to be limiting. Means for providing other aspects of an in utero environment or of traditional Kangaroo Care are contemplated by the present disclosure of an artificial kangaroo care apparatus. The placement and appearance of the means described herein are provided for exemplary purposes and are not meant to be limiting. Accordingly, an artificial kangaroo care apparatus may comprise internal and external elements that imitate an infant's pre-birth environment.

Traditionally, Kangaroo Care, as described above, may comprise an infant's placement on a mother's chest. The skin-to-skin contact between a mother, or other primary person, and an infant may calm an infant. For example, the "primary" skin-to-infant skin contact may recreate aspects of an in utero environment, such as a heart rate, a body temperature, a respiratory rate, or a smell. An artificial kangaroo care apparatus, in accordance with the present disclosure, may provide a means for an infant to have a similar experience when a mother or other primary person is unavailable. Accordingly, an artificial kangaroo care apparatus may provide skin-to-skin benefits without skin-to-skin contact.

In an exemplary embodiment, assembling an artificial kangaroo care apparatus, in accordance with the present disclosure, may comprise assembling a structure to imitate a pre-birth environment. In an embodiment, for example, assembling the artificial kangaroo care apparatus may comprise positioning an odor-absorbent material relative to a structure. In an exemplary embodiment, positioning the odor-absorbent material may comprise placing the odor-absorbent material in communication with a surface of the structure. In an alternative exemplary embodiment, positioning the odor-absorbent material may comprise lining an infant-holding pouch with the odor-absorbent material and placing the infant-holding pouch in communication with the surface of the structure. Other means for communicating an infant with the odor-absorbent material, and directly or indirectly communicating the odor-absorbent material with the structure, are contemplated by the present disclosure. In view of the positioned odor-absorbent material, an infant appropriately positioned relative to the surface of the structure may experience aspects of a pre-birth environment, such as a smell. Accordingly, assembling an artificial kangaroo care apparatus may comprise positioning an odor-absorbent material directly or indirectly in communication with a structure.

In an exemplary embodiment, assembling an artificial kangaroo care apparatus, in accordance with the present disclosure, may comprise assembling a structure with additional or alternative means to imitate a pre-birth environment. In an exemplary embodiment, assembling an artificial kangaroo care apparatus may comprise assembling a means for creating vibrating waves at a surface of a structure. In an embodiment, for example, assembling an artificial kangaroo care apparatus may comprise assembling a means for creating an up and down chest movement at the surface of the structure. In another exemplary embodiment, assembling an artificial kangaroo care apparatus may comprise assembling a means for generating body temperature at the surface of the structure. The selection of means described herein is provided for exemplary purposes. In view of the assembled means described herein, an infant appropriately positioned relative to the surface of the structure may experience aspects of a pre-birth environment, such as a heartbeat, a breathing pattern, or a body temperature, respectively. Means for providing other aspects of an in utero environment or of traditional Kangaroo Care are contemplated by the present disclosure. Accordingly, assembling an artificial kangaroo care apparatus may comprise assembling a structure with means to imitate a pre-birth environment.

Figure 3:
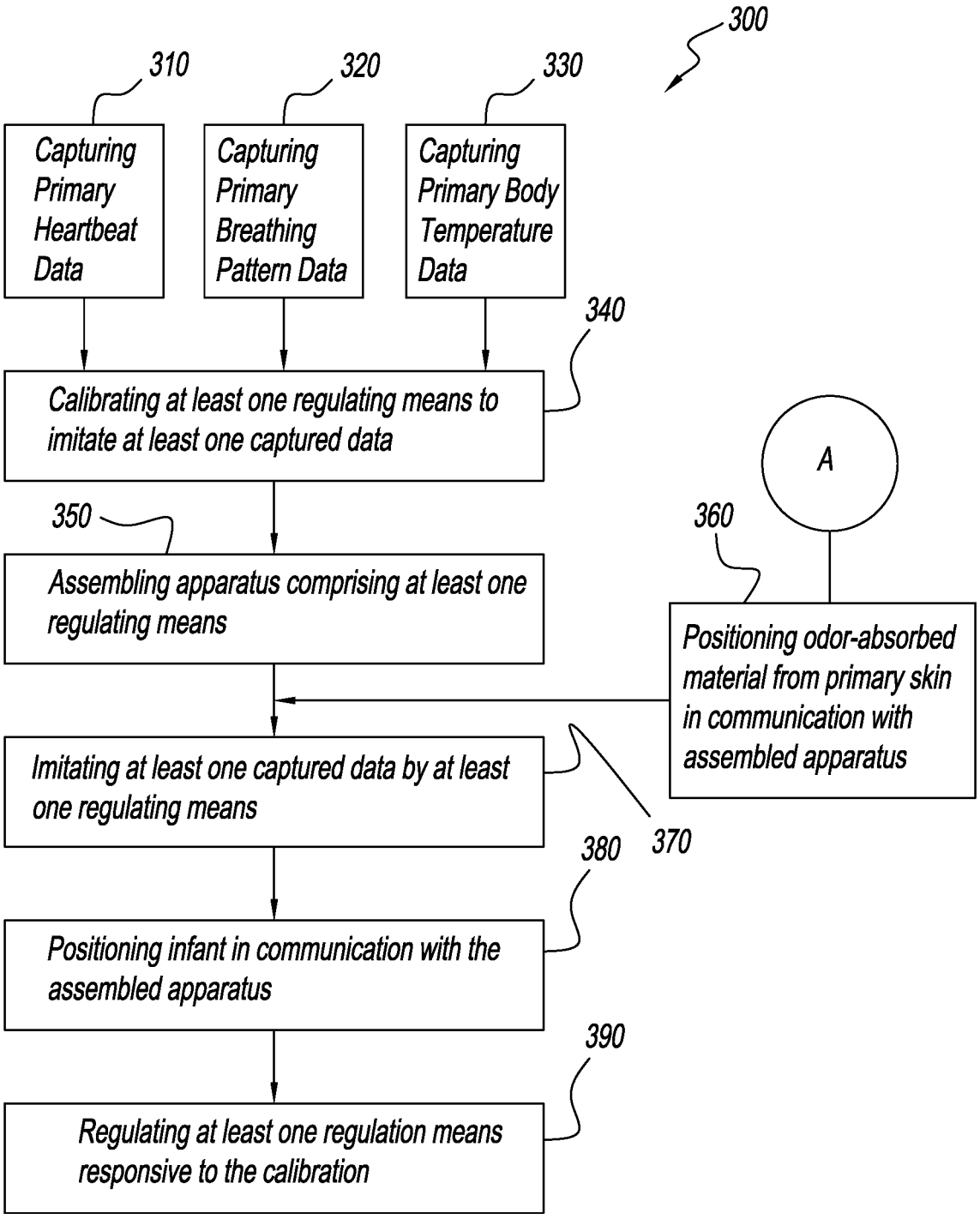
FIG. 3 illustrates a flow diagram showing assembling an artificial kangaroo care apparatus.

In an exemplary embodiment in accordance with the present disclosure, assembling an artificial kangaroo care apparatus may comprise assembling a structure with at least one means to regulate pre-birth environment experiences. In an embodiment, for example, regulating the pre-birth environment experiences may occur at an inner surface or an outer surface of the structure. FIG. 3 illustrates a flow diagram showing assembling an artificial kangaroo care apparatus (300) in accordance with the present disclosure. As described herein above, a primary person may comprise a mother, father, or other care giver. In an exemplary embodiment of the present invention, the method of assembling an artificial kangaroo care apparatus (300) may first comprise capturing primary heartbeat data (310), capturing primary breathing pattern data (320), or capturing primary body temperature data (330), or any combination thereof. In accordance with the present invention, any one or all of these data may be captured. The identification of these primary data is meant for exemplary purposes. Other primary data are contemplated by the present invention. In accordance with the present disclosure, the present invention is not limited to a specific means for capturing primary data; rather, the present invention contemplates all available means for capturing primary data. Accordingly, a method for assembling an artificial kangaroo care apparatus may comprise capturing primary data.

In an exemplary embodiment, the method of assembling an artificial kangaroo care apparatus (300) may further comprise calibrating at least one regulating means to imitate at least one captured data (340). In an exemplary embodiment, calibrating at least one regulating means may comprise generating at least one set point in view of the at least one captured primary data. For example, the at least one set point may be mean value or some other statistic associated with the at least one captured data. In an exemplary embodiment, a regulating means, after calibration, may imitate at least one of the captured primary heartbeat data, the captured primary breathing pattern data, the captured primary body temperature data, other primary data, or any combination thereof, in view of the at least one set point. In an exemplary embodiment, at least one or more regulating means may be employed, as described in FIG. 2, to imitate at least one of the captured data. In accordance with the present disclosure, the present invention is not limited to a specific means for calibrating at least one regulating means; rather, the present invention contemplates all available regulating means and all available means for calibrating the regulating means. Accordingly, a method for assembling an artificial kangaroo care apparatus may comprise calibrating at least one regulating means.

In an exemplary embodiment, the method for assembling an artificial kangaroo care apparatus (300) may further comprise assembling an apparatus comprising at least one regulating means (350). As described with respect to FIG. 2 and herein above, at least one or more regulating means may be employed in an artificial kangaroo care apparatus, and may imitate an infant's pre-birth environment, in accordance with the present disclosure. As described with respect to FIGS. 1A, 1B, and 2, an odor-absorbent material may be employed as an element of the artificial kangaroo care apparatus, and may imitate a primary person's smell, in accordance with the present disclosure. In an exemplary embodiment, a material having absorbed a primary skin odor, as described herein below with respect to FIG. 4, may be available for use. With that in mind, in an exemplary embodiment, the method of assembling an artificial kangaroo care apparatus (300) may further comprise positioning the odor-absorbed material from the primary skin in communication with the assembled apparatus (360). Accordingly, a method for assembling an artificial kangaroo care apparatus may comprise assembling at least one regulating means.

As described above, an assembled, artificial kangaroo care apparatus may comprise at least one component. In an exemplary embodiment, the method for assembling an artificial kangaroo care apparatus (300) may further comprise imitating at least one captured data by at least one regulating means (370). In an exemplary embodiment, an assembled apparatus may imitate at least one aspect of an infant's pre-birth environment. With the step of imitating at least one captured data by at least one regulating means (370) completed, the method for assembling an artificial kangaroo care apparatus (300) may further comprise positioning an infant in communication with the assembled apparatus (380). As described herein above, an artificial kangaroo care apparatus, in accordance with the present disclosure, may provide aspects of traditional Kangaroo Care when primary skin-to-infant skin contact may not be an available option. The step of positioning the infant in communication with the assembled apparatus (380) may support realizing Kangaroo Care benefits through use of the artificial kangaroo care apparatus, in accordance with the present invention. Maintaining the Kangaroo Care benefits may require monitoring a performance of the artificial kangaroo care apparatus in view of at least one set point established for at least one captured primary data. To that end, in an exemplary embodiment, the method for assembling an artificial kangaroo care apparatus (300) may further comprise regulating the at least one regulation means responsive to the calibration (390). Accordingly, a method for assembling an artificial kangaroo care apparatus may comprise regulating performance of an artificial kangaroo care apparatus to support Kangaroo Care objectives.

Figure 4:
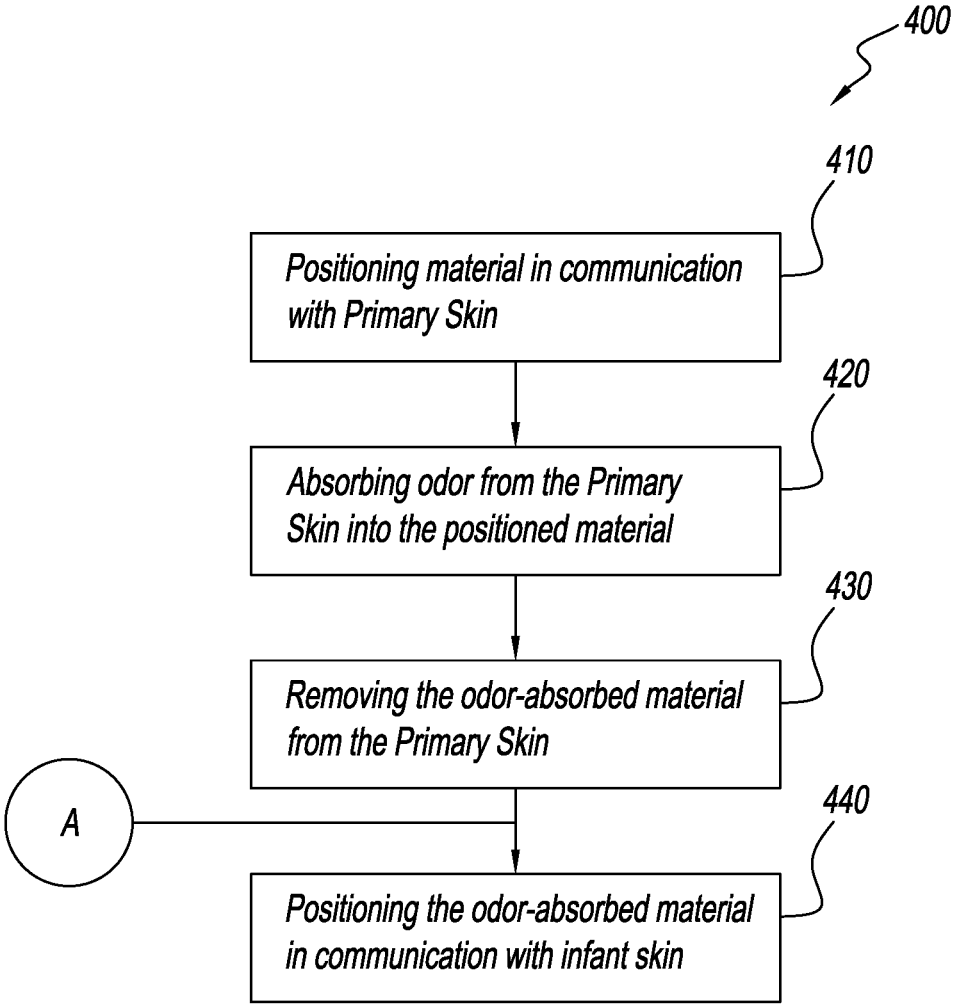
FIG. 4 illustrates a flow diagram showing preparing an odor-absorbent material.

FIG. 4 illustrates a flow diagram showing preparing an odor-absorbent material (400) in accordance with the present disclosure. As described above, infants may find comfort at birth through exposure to a mother's smell. In an exemplary embodiment, primary skin may be the mother's skin. Alternatively, primary skin may be a father's skin, a nurse's skin, or some other care giver's skin. In an exemplary embodiment of the present invention, the method of preparing an odor-absorbent material (400) may first comprise positioning material in communication with primary skin (410). In an exemplary embodiment, positioning material in communication with primary skin (410) may comprise wrapping material around primary skin or otherwise securing material to the primary skin. In an alternative embodiment, positioning material in communication with primary skin (410) may comprise wearing the material, which may form a shirt or other form of clothing. These means for positioning material in communication with primary skin are provide for exemplary purposes, and are not meant to be limiting. All available means for positioning material in communication with primary skin (410) are contemplated by the present invention. Accordingly, a method of preparing an odor-absorbent material may comprise positioning material in communication with primary skin.

In an exemplary embodiment, a method of preparing an odor-absorbent material (400) may comprise absorbing odor from the primary skin into the positioned material (420), and removing the odor-absorbed material from the primary skin (430). In an exemplary embodiment, as described herein above in FIG. 3, the odor-absorbed material removed from the primary skin may be positioned in communication with an assembled artificial kangaroo care apparatus. In an alternative embodiment, the odor-absorbed material may exist separate from the assembled artificial kangaroo care apparatus. For example, in an embodiment, the odor-absorbed material may be available for use in a traditional Kangaroo Care environment, or other environment. Once the odor-absorbed material has been removed from the primary skin, in an embodiment, for example, the method of preparing an odor-absorbent material (400) may further comprise positioning the odor-absorbed material in communication with infant skin (440). Accordingly, a method of preparing an odor-absorbent material may support Kangaroo Care objectives.

Figure 5:
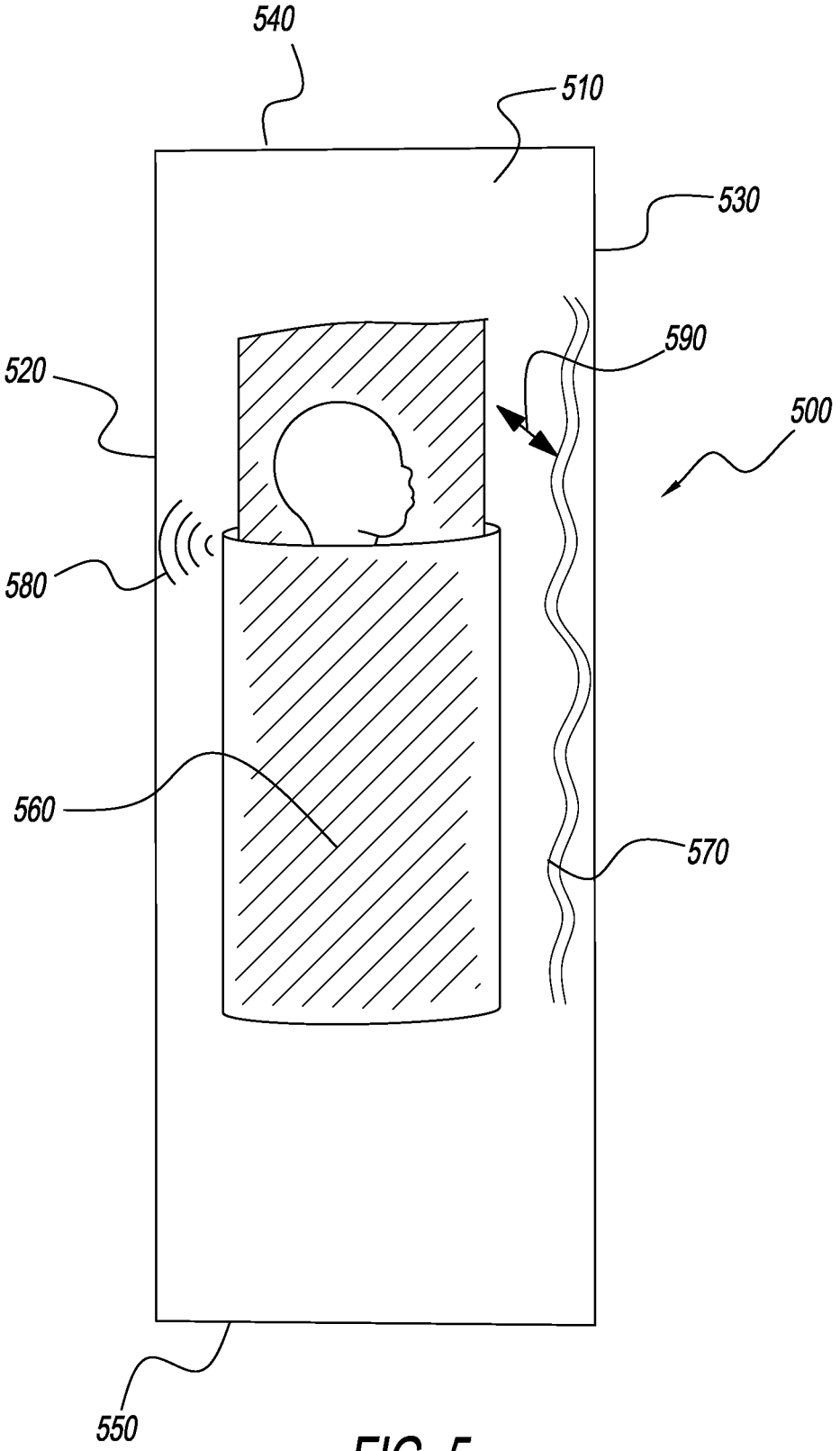
FIG. 5 illustrates a top view of an artificial kangaroo care apparatus.

FIG. 5 illustrates a top view of an artificial kangaroo care apparatus (500) in accordance with the present disclosure. An exemplary embodiment of an artificial kangaroo care apparatus may comprise a top face (510), a left edge (520), a right edge (530), a top edge (540), and a bottom edge (550). In an exemplary embodiment, an infant may communicate with the top face (510) of the artificial kangaroo care apparatus (500) through an odor-absorbent material (560). As shown, in an exemplary embodiment, the odor-absorbent material (560) may comprise a pocket-like form, which may create an opening to hold or contain an infant. The pocket-like form is provided for exemplary purposes. Other forms of odor-absorbent material (560), such as, but not limited to, a blanket, other form of covering, or other form of top sheet and bottom sheet combination, are contemplated by the present disclosure. In another exemplary embodiment, an odor-absorbent material may communicate with an infant, or may provide some means of odor-based comfort to the infant, as described above and with respect to FIG. 4, yet an alternative means may be employed to contain the infant. For example, an infant may be wrapped in an odor-absorbent material (560), the wrapped infant may be placed within a holding means, and the holding means may communicate with the top face (510). Accordingly, an artificial kangaroo care apparatus may comprise a means to contain an infant, and the artificial kangaroo care apparatus may offer odor-based comfort to the infant.

As described above with respect to FIGS. 1A and 1B, the artificial kangaroo care apparatus (500) may stand-alone or may form a covering. In an exemplary embodiment, the left edge (520), the right edge (530), the top edge (540), and the bottom edge (550) may communicate with enclosure walls of an incubator when in use. In another exemplary embodiment, the left edge (520), the right edge (530), the top edge (540), and the bottom edge (550) may form rigid edges or relaxed edges. The rigidity of the edges is provided for exemplary purposes and is not meant to be limiting. In an embodiment, for example, the overall structure or form of the artificial kangaroo care apparatus (500), such as, but not limited to, a stand-alone structure, mattress, or mattress cover, may dictate the rigidity of the edges. Accordingly, a top face of an artificial kangaroo care apparatus may be bound by rigid or less-than-rigid edges.

As described herein above, and with respect to FIG. 2, in an exemplary embodiment, the artificial kangaroo care apparatus (500) may comprise a temperature regulating means (260), a heartbeat regulating means (270), a breathing pattern regulating means (280), or any combination thereof. As described above, an exemplary embodiment of the artificial kangaroo care apparatus (500) may employ these means to recreate elements of a pre-birth environment. In an embodiment, for example, a temperature regulating means (260) may generate a temperature gradient (570) at the top face (510) of the artificial kangaroo care apparatus (500). In another exemplary embodiment, a heartbeat regulating means (270) may generate vibrating waves (580), or other simulation of a mother's heartbeat, at the top face (510) of the artificial kangaroo care apparatus (500). In an embodiment, for example, a breathing pattern regulating means (280) may generate an up and down motion (590) at the top face (510) of the artificial kangaroo care apparatus (500). The means and the generated operations at the top face (510) are provided herein for exemplary purposes. Other means and generated operations are contemplated by the present disclosure. Accordingly, an artificial kangaroo care apparatus may generate operations to recreate a pre-birth environment.

It is to be understood that the various embodiments shown and described herein are to be taken as exemplary. Elements and materials, and arrangements of those elements and materials, may be substituted for those illustrated and described herein, parts may be reversed, and certain features of the present disclosure may be utilized independently, as would be apparent to one skilled in the art after having the benefit of the description herein. Changes may be made in the elements described herein without departing from the spirit and scope of the present disclosure and following claims, including their equivalents.

It is to be understood that the particular embodiments set forth herein are non-limiting, and modifications to structure, dimensions, materials, and methodologies may be made without departing from the scope of the present disclosure.

It is to be further understood that this description's terminology is not intended to limit the invention. For example, spatially relative terms, such as "front," "back," "top," "bottom," "side," and the like, may be used to describe one element's or feature's relationship to another element or feature as intended to connote the orientation of, for example, the artificial kangaroo care apparatus as illustrated in the figures.

For the purposes of this specification and appended claims, unless otherwise indicated, all numbers expressing quantities, percentages or proportions, and other numerical values used in the specification and claims, are to be understood as being modified in all instance by the term "about" if they are not already. That is, unless indicated to the contrary, the numerical parameters set forth in the specification and claims are approximations that may vary depending on the desired properties sought to be obtained by the present disclosure.

What is claimed is:

1. An artificial kangaroo care apparatus comprising:

a structure, wherein the structure comprises an internal cavity;

at least one primary pre-birth data capture unit;

at least one primary pre-birth regulating unit, which imitates at least one captured primary pre-birth data; and at least one primary pre-birth data calibration unit, which calibrates the at least one primary pre-birth regulating unit.

2. The kangaroo care apparatus of claim 1, further comprising an imitating smell unit.

3. The kangaroo care apparatus of claim 2, wherein the imitating smell unit comprises an odor-absorbed material in communication with the structure.

4. The kangaroo care apparatus of claim 1, wherein the primary pre-birth regulating unit is positioned within the internal cavity.

5. The kangaroo care apparatus of claim 1, wherein the structure further comprises an infant incubator mattress.

6. The kangaroo care apparatus of claim 1, wherein the primary pre-birth regulating unit comprises a heartbeat regulating unit.

7. The kangaroo care apparatus of claim 1, wherein the primary pre-birth regulating unit comprises a breathing pattern regulating unit.

8. The kangaroo care apparatus of claim 1, wherein the primary pre-birth regulating unit comprises a body temperature regulating unit.

9. The kangaroo care apparatus of claim 1, further comprising an infant positioning unit.

10. A method of assembling an artificial kangaroo care apparatus, the method comprising:

capturing at least one primary pre-birth data;

assembling at least one primary pre-birth regulating subunit, calibrating the at least one assembled primary pre-birth regulating subunit;

assembling a structure comprising the at least one calibrated primary pre-birth regulating subunit;

the at least one calibrated primary pre-birth regulating subunit imitating the at least one captured primary pre-birth data; and regulating the at least one calibrated primary pre-birth regulating subunit responsive to the calibrating.

11. The method of claim 10, wherein the at least one captured primary pre-birth data comprising breathing pattern data and the at least one calibrated primary pre-birth regulating subunit comprising a calibrated primary pre-birth breathing pattern regulating subunit.

12. The method of claim 10, wherein the at least one captured primary pre-birth data comprising body temperature data and the at least one calibrated primary pre-birth regulating subunit comprising a calibrated primary pre-birth body temperature regulating subunit.

13. The method of claim 10, wherein the at least one captured primary pre-birth data comprising heartbeat data and the at least one calibrated primary pre-birth regulating subunit comprising a calibrated primary pre-birth heartbeat regulating subunit.

14. The method of claim 10, the method further comprising:

positioning odor-absorbed material in communication with a surface of the assembled structure.

15. A method of artificial kangaroo care, the method comprising:

capturing at least one primary pre-birth data;

assembling at least one primary pre-birth regulating subunit;

calibrating the at least one assembled primary pre-birth regulating subunit;

assembling a structure comprising the at least one calibrated primary pre-birth regulating subunit;

the at least one calibrated primary pre-birth regulating subunit imitating the at least one captured primary pre-birth data;

regulating the at least one calibrated primary pre-birth regulating subunit responsive to the calibrating;

positioning material in communication with primary skin;

absorbing odor from the primary skin into the positioned material; and positioning the odor-absorbed material in communication with infant skin.

16. The method of claim 15, wherein the at least one primary pre-birth data comprises heartbeat data.

17. The method of claim 15, wherein the at least one primary pre-birth data comprises breathing pattern data.

18. The method of claim 15, wherein the at least one primary pre-birth data comprises body temperature data.

* * * * *